United States Patent [19]

Pinson

[11] Patent Number: 5,007,348

[45] Date of Patent: Apr. 16, 1991

[54] SPHERICAL PROJECTILE FOR ELECTROMAGNETIC ACCELERATION

[75] Inventor: George T. Pinson, Huntsville, Ala.

[73] Assignee: The Boeing Company, Seattle, Wash.

[21] Appl. No.: 96,294

[22] Filed: Sep. 8, 1987

Related U.S. Application Data

[63] Continuation of Ser. No. 792,116, Oct. 28, 1985, abandoned.

[51] Int. Cl.[5] ..... F42B 15/00

[52] U.S. Cl. ..... 102/501; 89/8; 124/3; 310/309

[58] Field of Search ..... 310/308–310; 124/3; 89/8; 376/101; 328/230, 232, 233, 234, 235; 102/501

[56] References Cited

U.S. PATENT DOCUMENTS

| | | | |
|---|---|---|---|
| 2,005,451 | 6/1935 | Browne | 310/308 |
| 2,208,217 | 7/1940 | Landerholm | 310/308 |
| 2,827,577 | 3/1958 | Kimberlin, Jr. | 310/308 |
| 4,133,854 | 1/1979 | Hendricks | 376/152 |
| 4,138,317 | 2/1979 | Porter | 376/101 |
| 4,138,609 | 2/1979 | Goodman | 376/101 |
| 4,162,914 | 7/1979 | Cremer | 219/121.51 |
| 4,163,637 | 8/1979 | Hendricks | 376/916 |
| 4,449,441 | 5/1984 | McAllister | 89/8 |
| 4,565,571 | 1/1986 | Abbaschian | 219/7.5 |
| 4,765,222 | 10/1988 | Pinson | 313/360.1 |

FOREIGN PATENT DOCUMENTS

| | | | |
|---|---|---|---|
| 1074138 | 1/1960 | Fed. Rep. of Germany | 310/309 |
| 0745783 | 2/1976 | United Kingdom | 310/309 |

OTHER PUBLICATIONS

International Dictionary of Physics & Electronics; D. Van Nostrand Co., Inc., Princeton, N.J., New York, N.Y., 1956, pp. 563 & 940.

IBM Tech. Discl. Bulletin, "Bouncing Ball Generator", J. B. Gunn; vol. 5, No. 8, Jan. 1963.

*Primary Examiner*—R. Skudy

*Attorney, Agent, or Firm*—Finnegan, Henderson, Farabow, Garrett & Dunner

[57] ABSTRACT

An electrically charged spherical projectile for use in acceleration devices such as betatrons, cyclotrons, linear accelerators and similar devices. The spherical projectile having a large hollow or low mass filled spherical body which can be electrically charged and perform the same functions as an electron or ion.

10 Claims, 1 Drawing Sheet

SPHERICAL PROJECTILE FOR ELECTROMAGNETIC ACCELERATION

This application is a continuation-in-part, application Ser. No. 06/792,116, filed Oct. 28, 1985, now abandoned.

BACKGROUND OF THE INVENTION

This invention relates to an electrically charged spherical projectile and more particularly a hollow projectile having a ratio of surface area to mass greater than that of a solid body of a basic material to be charged.

Heretofore charged particle work in the field of electrostatics has been restricted to elemental particles or microparticles. It has been shown that large bodies can be charged in accordance with the laws of electrostatics. But applications of this science have been limited to generally areas such as electrostatic painting techniques, electrostatic separation of minerals, impactless printing, charge transfer as in xerography and dust and flue materials collection.

All of these applications have in common the charging or application of charges on small bodies. The dimensions of these bodies are typically particle mass$=10^{-8}$ grams, particle charge$=10^{-14}$ coulombs and particle radius$=10$ microns.

In the case of impactless printers the radius of the particles may get to be as high as 60 microns, and in the case of mineral separation, radii as large as 0.12 mm have been used.

From a theoretical viewpoint, all of the existing systems are based on following first order physics. More detailed analysis does not materially affect the conclusions. The charge on a particle is proportional to its surface area, and for a spherical particle, is related to the particle radius by $$q=KR^2$$

where:

q is the charge in coulombs

K is a constant

R is the radius of the particle in meters.

The forces acting on the particle when it resides between two plates operated at potential difference V are:

$$F=qV/D=ma$$

where:

V is the potential

D is the distance between the plates m is the mass of the particle a is the acceleration of the particle F is the force acting on the particle $$a=\frac{KR^2V}{4/3\pi R^3SG\,Dp_w}=\frac{K_1R^2V}{R^3SG\,Dp_w}$$

where $K_1=(K/4/3\pi)$, SG is the specific gravity of the round particles, and $p_w$ is the mass per unit volume for water at 4° C. The acceleration can be written $$a=\frac{K_1{*}V}{R{*}SG{*}D{*}p_w}=\frac{K_1{*}E}{R{*}SG{*}p_w}$$

where E is the average electric field intensity (V/D) between the plates.

None of the previous applications, as described above, have used charged particles having a large mass but instead all of the particles are of dust or sand dimensions and smaller.

SUMMARY OF THE INVENTION

The subject invention provides, a large hollow or low-mass-filled spherical or nonspherical body that can be charged by conventional means to accept either a positive or negative electrical charge.

The projectile after being electrically charged will perform the same functions and react to electrical and magnetic fields in the same manner as an electron or ion or any other negatively or postively charged particle when the size, mass and inertia of the body is taken into account. The invention provides an analog of an electron or ion, herein called a projectile, for use in acceleration devices such as betatrons, cyclotrons, linear accelerators and other similar devices which currently are operated by accelerating electrons, protons and ions.

The electrically charged projectile is preferably hollow although a lightweight foam or gas filler may be used. The projectile must have a ratio of surface area to mass greater than that of a solid body of a basic material that is to be charged. The thickness of the projectile may be varied to meet surface area to mass requirements for the application desired. Further, an orifice may be provided to assure that there is equalization of pressure inside the projectile or where a high pressure differential may occur.

The advantages and objects of the invention will become evident from the following detailed description of the drawings when read in connection with the accompanying drawings which illustrate preferred embodiments of the invention.

DETAILED DESCRIPTION OF THE DRAWINGS

Figure 1:
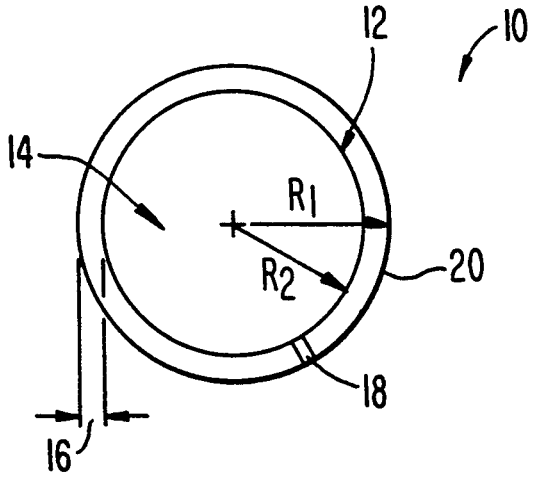
FIG. 1 is a cross-sectional view of an embodiment of the invention.

One embodiment of the present invention having a general reference numeral 10 is a hollow ball which is constructed by conventional means such that all of the mass is located in a thin outside layer shell 12 shown in FIG. 1. Under this condition:

$$a=\frac{qV}{mD}=\frac{KR_1^2V}{mD}=\frac{KER_1^2}{m}$$

where: $R_1$ is the outside radius of the projectile 10 and $R_2$ is the radius of the central void, it follows that:

$$a=\frac{KER_1^2}{(4/3\pi R_1^3-4/3\pi R_2^3){*}SG{*}P_w}=\frac{K_1ER_1^2}{SG{*}(R_1^3-R_2^3){*}p_w}$$

It is next observed that $$R_1^3-R_2^3=(R_1-R_2)(R_1^2+R_1R_2+R_2^2)$$

Let $$\Delta R=R_1-R_2$$

Then assuming the shell 12 to be sufficiently thin allows the cubic expression to be written $$R_1^3 - R_2^3 \approx \Delta R\ (3R^2)$$

where R is $$R = \tfrac{1}{2}(R_1 + R_2)$$

For the acceleration to be a maximum for a given field strength E, the quantity R*SG must be a minimum. For this to occur, R must be minimized for any given specific gravity (SG). It is therefore necessary, for a solid particle, that R be small. As an example, let $E = 10^9$ volts/meter, which is a typical breakdown field strength for the atmosphere which remains in a typically attainable vacuum. For this value of E, $$a = \frac{K_1 * 10^9}{SG * R * p_w} = \frac{K_2}{SG * R * p_w} \text{ where } K_2 = \frac{3K}{4\pi} \times 10^9 \text{ joules}/m^3$$

For SG=2, $K_1 = 3K/4\pi = 2.6 \times 10^{-2}$ coulombs/m$^2$ and $p_w = 1$ gm/cm$^3$ = 1000 kg/m$^3$ then $a = 1.3 \times 10^4/R$ M/sec$^2$ It is therefore obvious that for the acceleration of a solid particle in a field to be maximized, R must be minimized.

The velocity gained by a charged particle passing through a potential V is $$v = \left(\frac{2\,(KR^2)\,V}{4/3\pi R^3\ SG\ p_w}\right)^{\frac{1}{2}}$$

$$= 2\left(\frac{3K}{4\pi}\right)\frac{1}{(2)\,(10^3)}\ \frac{V^{\frac{1}{2}}}{R}$$

$$\therefore \text{Velocity} = 0.005099\ V^{\frac{1}{2}}/R^{\frac{1}{2}}$$

In conclusion, at any potential level it is mandatory that the radius of solid particles be minimized if the speed is to be maximized. For $V = 3.2 \times 10^9$ volts, and for values of R = 10, 1, 0.1, and 0.01 meters, the velocity is respectively, 91, 287, 907, 2870 m/sec.

Up to this point, it has been shown that the acceleration performance of a solid particle is improved by making the particle smaller. Reducing the particle mass does help, but a penalty is paid in that the charge which can be carried is also reduced because of the smaller surface area. The present invention overcomes this deficiency by greatly increasing the area-to-mass ratio over that of a homogeneous solid particle.

A center 14 of the projectile 10 is preferably hollow, although a lightweight foam or gas filler may be used as long as the ratio of surface area to mass is greater than that of a solid body of the basic material that is to be charged. A thickness 16 of the projectile 10 may be varied to meet the surface-area-to-mass requirements for the application. An orifice 18 may be provided to assure that there is an equalization of pressure inside the projectile 10 for use in space or any other application where a high pressure differential might occur.

It should be noted that the time constant for which a charge spreads itself over the surface is $\tau = \epsilon p \epsilon r/\sigma$. Since $\sigma = 0$ for a nonconductive surface, the deposited charge would not spread from the deposition location. Failure to spread would be detrimental to performance. The use of an electron or ion beam for charging will, however, resolve this problem.

The coatings 20 on the projectile 20 on the projectile 10 can be made of multiple flashes of different materials to provide desired electrical characteristics. The coatings can be continuous or provide a symmetrical or nonsymmetrical electrically conducting pattern for a specific application.

Although it is defined that the preferred embodiment is a round body as shown in FIG. 1, this is not a requirement for the projectile 10. The body can be of any shape provided that the basic property of the projectile is satisfied: namely $$\left[\frac{\text{SURFACE AREA}}{\text{MASS}}\right]_{PROJECTILE} > \left[\frac{\text{SURFACE AREA}}{\text{MASS}}\right]_{\substack{CORRESPONDING\\ SOLID\ BODY}}$$

When placed in an electron or an ion beam, the hollow sphere with shell 12 shown in FIG. 1, if the outside coating is conductive, will acquire a charge q as given by the relationship:

$$q = \pi r^2 JR/v$$

where:

r is the radius of the projectile j is the beam current density (amps/m$^2$)

R is the charging beam diameter v is the speed with which the projectile passes through the beam cross section.

with $R_1$ replaced by R in the numerator of the acceleration expression, and with the above approximation for the cubic expression substituted in the denominator, the acceleration of a thin-projectile 10 is given by $$a = \frac{K_1\ E}{3\ SG\ p_w\ \Delta R}$$

It is thus seen that for a projectile 10 which is either hollow, or which has most of its mass concentrated in the outer shell 12, the acceleration due to an externally applied electric field is enhanced by making the shell 12 as thin as possible.

In the preferred design the projectile 10 is made up of the thin shell 12 with a conductive coating 20. If a nonconductive outer shell is used it can be coated with a thin layer of electrically conductive materials by such processes as sputtering, plating, painting, etc. Sputtering with gold makes an ideal coating, in that secondary emission during the charging process is reduced.

This expression also assumes that secondary emission is negligible, as should be the case when the outer conductive layer is gold, for example.

Contact charging is given by: $q = 1.65 \times 4\ \pi R^2 E_o$

In its charged state, the projectile behaves as an electron or ion, depending upon the charge sign. It can be accelerated by a field and exhibit the characteristics of a moving charge. When consideration is made for the size, mass, and inertia of the projectile, it is subject to the same laws of physics as is an electron or ion. The projectile 10 is used in applications where it is suspended, supported or otherwise acted upon by electrical and/or magnetic fields.

Changes may be made in the construction and arrangement of the parts or elements of the embodiments as described herein without departing from the spirit or scope of the invention defined in the following claims:

What is claimed is:

1. A projectile for electromagnetic acceleration comprising:

a generally spherical shell having an exterior surface and defining an enclosed void, lightweight foam material filling said void, the ratio of the area of said exterior surface to the mass of said shell being substantially greater than that of a corresponding solid body, said shell having an orifice therein for eliminating any pressure differential between said void and the outside of said shell; and means on a substantial portion of said exterior surface for holding an electric charge which is sufficient to accelerate said shell in response to an electric field in a manner similar to the reaction of an ion to an electric field.

2. The projectile of claim 1 wherein said shell is of an electrically conductive material and wherein said electric charge holding means is the electrically conductive characteristics of said material.

3. The projectile of claim 1 wherein said shell is of a non-conductive material.

4. The projectile of claim 3 wherein said electric charge holding means comprises an electrically conductive coating disposed on said surface.

5. The projectile of claim 4 wherein said coating is continuous.

6. The projectile of claim 4 wherein said coating is disposed in a pattern on said surface.

7. A projectile for electromagnetic acceleration comprising:

a generally spherical shell having an exterior surface and defining an enclosed void, lightweight foam material filling said void, the ratio of the area of said exterior surface to the mass of said shell being substantially greater than that of a corresponding solid body; and an electroconductive coating disposed on a substantial portion of said exterior surface for holding an electric charge which is sufficient to accelerate said shell in response to an electric field in a manner similar to the reaction of an ion to an electric field.

8. The projectile as in claim 7, wherein the projectile has an orifice therein for eliminating a pressure differential between said void and the outside of said body.

9. The projectile as in claim 7, wherein the electrically conductive coating is continuous.

10. The projectile as in claim 7, wherein the electroconductive coating is disposed in a pattern on the surface.

* * * * *